United States Patent [19]

Freeman

[11] 4,220,017

[45] Sep. 2, 1980

[54] CONVERTIBLE FINGER RING

[75] Inventor: Harold Freeman, New York, N.Y.

[73] Assignee: Harold Freeman Jewelry Mfg. Co., Inc., New York, N.Y.

[21] Appl. No.: 931,518

[22] Filed: Aug. 7, 1978

[51] Int. Cl.[2] ..... A44C 9/00; A44C 15/00

[52] U.S. Cl. ..... 63/15; 63/31

[58] Field of Search ..... 63/1, 2, 15, 31

[56] References Cited

U.S. PATENT DOCUMENTS

| | | | |
|---|---|---|---|
| 2,914,928 | 12/1959 | Warden | 63/31 X |

FOREIGN PATENT DOCUMENTS

| | | | |
|---|---|---|---|
| 96944 | 4/1898 | Fed. Rep. of Germany | 63/15 |
| 766125 | 4/1934 | France | 63/15 |
| 1381490 | 11/1964 | France | 63/31 |
| 418033 | 2/1967 | Switzerland | 63/31 |

*Primary Examiner*—F. Barry Shay

*Attorney, Agent, or Firm*—Friedman, Goodman & Teitelbaum

[57] ABSTRACT

A convertible finger ring including a ring band supporting a gem mount, the ring band being generally U-shaped to provide resilient arms. The gem mount is received between the arms of the ring band at the ends thereof. A pin is disposed axially through the arms and gem mount to define a pivot upon which the gem mount may be rotated relative with respect to the ring band arms to provide either a pendant or ring configuration. The abutting faces of the ring band and gem mount are provided with complimentary projections and detents so that the resilient force of the ring band arms urges them into engagement to maintain the selected configuration. A shoulder portion of the gem mount prevents axial rotation beyond the finger ring and pendant configurations.

12 Claims, 12 Drawing Figures

CONVERTIBLE FINGER RING

BACKGROUND OF THE INVENTION

This invention relates generally to an item of jewelry, and more particularly to a finger ring having a ring portion pivotally connected to a gem mount portion. The gem mount portion is positionably in either a finger ring or pendant mode.

Finger rings are well known in the prior art. There have been numerous configurations and decorative designs incorporated into ring structures in the past. Several of these designs provide features which enable a portion of the ring to function as both a decorative face or gem mount thereon.

There have been several attempts to provide a ring structure which incorporates a decorative face or gem mount which can be rotated, in relation to the finger ring band, to a position where the ring can be worn by the wearer as either a pin or pendant. However, these efforts have generally included the incorporation of a separate detachable portion which the wearer must remove from the ring and then separately wear as a pendant, as in U.S. Pat. No. 3,192,737. In another form of convertible finger ring, as in U.S. Pat. No. 1,548,645, a gem setting bezzle is pivotally secured to the arms of the ring band. However, there is no provision for the accurate positioning of the gem setting bezzle which rotates freely. In another form of convertible finger ring, as in U.S. Pat. No. 2,287,865, the ring band utilizes a resilient material which when disengaged from one corner of the gem mount is used as a pin enabling the wearer to convert the ring into a decorative apparel pin.

Finger rings have also been provided with frames securing a reversibly decorative face which is freely rotatable around an axis, as in U.S. Pat. No. 3,959,989. In these structures the ring and decorative portion of the ring are not selectively positionable. Thus, the wearer cannot easily and securely reposition the decorative face relative to the ring band to enable it to be converted into a pendant, where the decorative face faces the observer of the person wearing the pendant and is not freely rotatable from that position.

SUMMARY OF THE INVENTION

The present invention overcomes the shortcomings inherent in the prior art by providing a convertible finger ring having a U-shaped member, which is adapted to be worn around a person's finger, and a pivotally mounted crown member or gem mount disposed between the end portions of the U-shaped member. The gem mount pivots from its ring position, which is perpendicular to the U-shaped ring band, to the pendant position lying in the same plane as the ring band. The ring band is provided with a pair of openings to receive a chain therethrough for use as a pendant.

The abutting faces of the ring band and gem mount are provided with complimentary projections and detents. The width between the faces of the ring band is slightly smaller than the width between the cooperating faces of the gem mount. Accordingly, by use of a suitable material the ring band arms resiliently expand when the gem mount is placed therebetween and the arms then provide a contractive force which urges the engagement of the complimentary detents and projections to maintain a selected configuration. A channel is provided through the ring band faces and gem mount to enable a pin to be inserted therethrough. The pin is provided with enlarged heads to prevent its removal from the channel of the convertible finger ring.

One of the principal objects of the present invention is to provide a convertible ring which has a gem mount portion which can be rotated from the finger ring to the pendant configuration.

Another object of the present invention is to provide an improved means of securing the gem mount to the ring band which is capable of securely positioning the gem mount and ring band relative to each other yet permitting easy rotation between these two configurations.

Another object of the present invention is to provide an economical and efficient means of constructing a finger ring which includes a gem mount which can be rotated to a pendant configuration.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawings like reference characters designate like parts.

DETAILED DESCRIPTION OF THE PREFERRED EMBODIMENT

Figure 1:
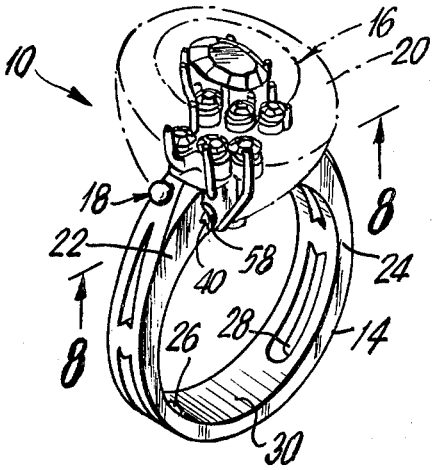
FIG. 1 is a perspective view of the convertible finger ring in the finger ring configuration according to the present invention.
Figure 2:
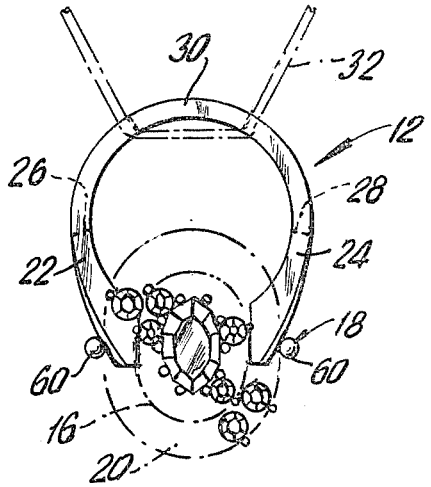
FIG. 2 is a front elevational view showing the convertible finger ring in the pendant configuration.
Figure 3:
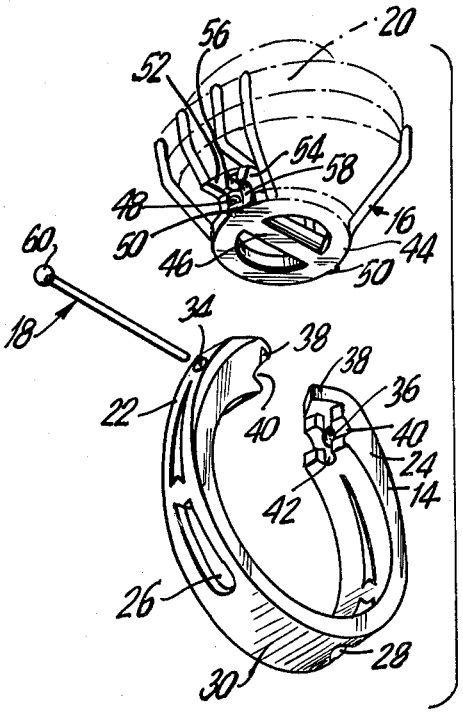
FIG. 3 is an exploded perspective view.

Referring now to the drawings, the convertible finger ring of the present invention is shown in the finger ring configuration 10 in FIG. 1, and in the pendant configuration 12 in FIG. 2. The convertible finger ring includes a ring band 14 and an ornamental gem mount 16, which are pivotally connected together by a pin 18. The gem mount 16 may have any suitable shape to provide a desired decorative appearance such as suitable facets and gem settings 20 as shown in FIGS. 1, 2 and 3. However, these decorative elements have been illustrated by way of example only, and have been eliminated from the remaining figures in order to more clearly understand the mechanical elements of the present invention.

As best shown in FIG. 3, the ring band 14 is U-shaped to provide a pair of spaced apart resilient arms 22 and 24. The ring band 14 is preferably fabricated from a precious metal, however other suitable materials may be used which are capable of providing resilient arms for movement of their free ends towards and away from each other. Openings 26 and 28 are provided adjacent to the bight portion 30 of the ring band 14 to receive a conventional chain 32 therethrough when in the pendant configuration 12, as shown in FIG. 2, so that the convertible finger ring of the present invention can be worn as a pendant about the neck of the wearer.

Holes 34 and 36 are provided through each of the free ends of the ring band 14 to receive the pin 18 as will be discussed hereinafter below. Additionally, each free end is provided with a tapered projection 38 extending in a direction towards each other, and a set of detents or recesses 40, 42 which are preferably disposed at right angles with respect to each other, the function of these projections and detents will be set forth hereinafter below.

The gem mount 16 includes a base portion 44 having a centrally disposed bridge portion 46 extending from one side of the base portion 44 to the other side thereof. An opening 48 extends through the bridge portion 46 for receiving the pin 18 therethrough, in a manner set forth hereinafter below. A pair of opposed outwardly directed projections 50 are provided at opposite ends of the bridge portion 46. A pair of shoulder members 52 are also provided on opposite sides of the bridge portion 46. Each shoulder member cooperates with a ridge member 54 to provide a channel or recess 56 therebetween. Additionally, a detent or recess 58 is provided in each ridge member 54. The function of the above mentioned elements of the base portion 44 will be described hereinafter below.

Figure 8:
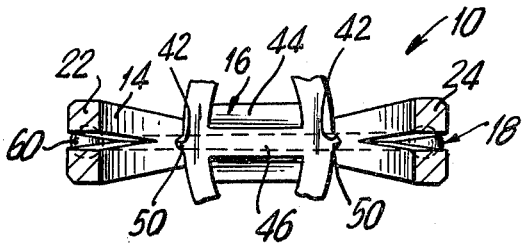
FIG. 8 is an enlarged fragmented sectional view taken along line 8—8 of FIG. 1 showing a bottom view of the engaging portions of the ring configuration.

According to the present invention, the spacing between the projections 38 of the ring band 14 in its untensioned or natural state is equal to or slightly less than the distance between the bottom walls of both the detents 56 and 58 of the base portion 44 of the gem mount 16, see FIG. 8. Thus, when assembling the convertible finger ring of the present invention, the projections 38 are positioned in either of the detents 56 so that the apertures or openings 34, 36 and 48 are in alignment with each other. The pin 18 is then passed through these openings to connect the gem mount 16 to the ring band 14.

Preferably, one end of the pin 18 is provided with an enlarged head 60 prior to insertion, and the opposite end of the pin 18 is also provided with an enlarged head 60 after being inserted through the openings 34, 48, 36, so that the pin 18 cannot be removed from the openings which are smaller in diameter than the enlarged heads 60. The enlarged heads 60 can be secured to the pin 18 in any conventional manner well known in the art. However, it is noted, that the enlarged heads 60 of the pin 18 are slightly spaced from the sides of the arms 22, 24 of the ring band 14 to allow the free ends of the arms 22, 24 to be moved slightly away from each other, as will be explained more fully hereinafter below.

Figure 4:
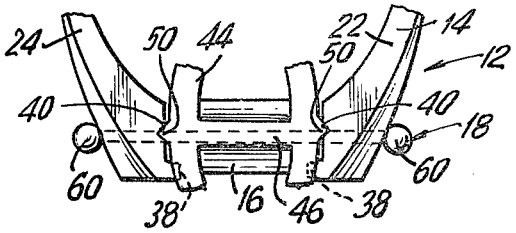
FIG. 4 is an enlarged fragmented rear elevational view of the engaging portions of the pendant configuration shown in FIG. 2.
Figure 5:
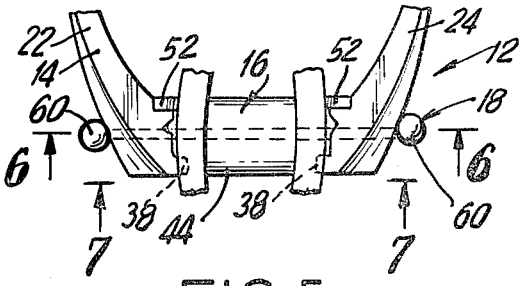
FIG. 5 is a fragmented front elevational view of the engaging portions of FIG. 4.
Figure 6:
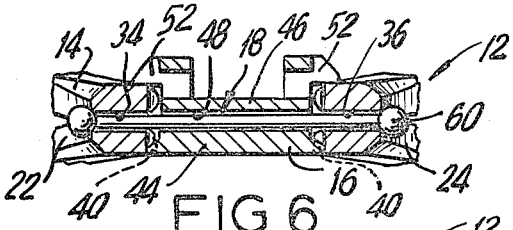
FIG. 6 is a fragmented sectional view taken along line 6—6 of FIG. 5.
Figure 7:
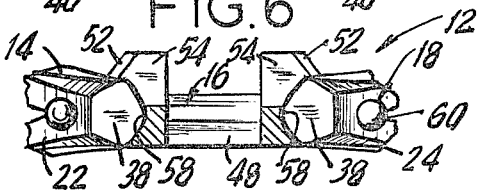
FIG. 7 is a fragmented sectional view taken along line 7—7 of FIG. 5.

We refer now to FIGS. 4–7 which more clearly show the engaging portions between the ring band 14 and the gem mount 16 when in the pendant configuration 12 shown in FIG. 2. Thus, in the pendant configuration 12, the projections 50 of the base portion 44 are disposed in the detents 40 as shown in FIG. 4, and the projections 38 at the free ends of the arms 22, 24 are disposed in the detents 58, as shown in FIG. 7. Though two sets of projections 50 and 38 are shown for cooperation with their associated detents, it is understood that the present invention could function with only one such set of projections 50 or 38 in order to provide a removable engagement between the gem mount base portion 44 and the ring band arms 22, 24 to selectively position these members in either the ring configuration or the pendant configuration.

The shoulder members 52 as shown in FIGS. 5 and 6, each have an edge abutting against the arms 22, 24 respectively to prevent the base portion 44 from being rotated beyond the pendant configuration. Accordingly, when the base portion 44 is pivoted on the pin 18 to the pendant configuration, the shoulder members 52 are rotated into contact with the arms 22, 24, so that further rotation thereof is prevented.

Figure 9:
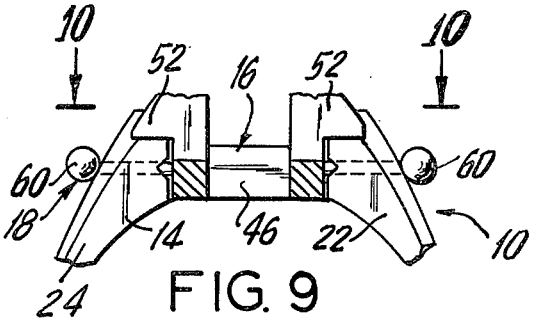
FIG. 9 is a fragmented side elevational view of the engaging portions shown in FIG. 8.
Figure 10:
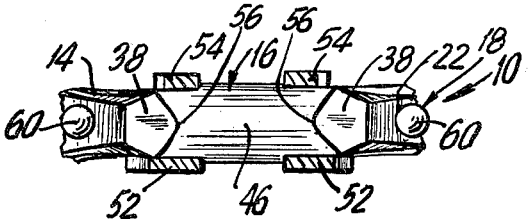
FIG. 10 is a fragmented sectional view taken along line 10—10 of FIG. 9.

Reference is now made to FIGS. 8–10, showing the ring configuration 10. Accordingly, in the ring configuration, the projections 50 of the base portion 44 are disposed in the detents 42 of the arms 22, 24 as shown in FIG. 8, and the projections 38 of the arms 22, 24 are disposed in the detent or channel 56 of the base portion 44, as shown in FIG. 10. Here again, it is possible to provide only one set of projections 50 or 38 to selectively position the gem mount 16 in the ring configuration 10.

As shown in FIGS. 9 and 10, the sides of the shoulder members 52 engage surfaces of the arms 22, 24 to prevent further rotation of the gem mount 16 beyond the ring configuration 10. The engaging sides of the shoulder members 52 are adjacent and substantially perpendicular to the above mentioned engaging edges thereof. As clearly shown in FIGS. 5 and 9, the surfaces of the arms 22, 24 which are engaged by the shoulder members 52 are disposed on opposite sides of the pin 18, where FIG. 5 shows one pair of engaging surfaces being disposed on the inner part of the free end portions of the arms, and FIG. 9 shows the other pair of engaging surfaces being on the outer part thereof.

Figure 11:
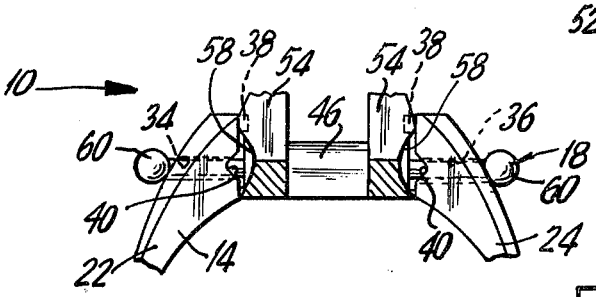
FIG. 11 is a fragmented side elevational view of the reverse side of that shown in FIG. 9.
Figure 12:
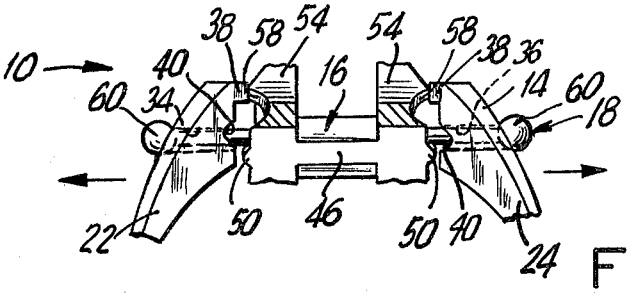
FIG. 12 is a side elevational view showing the expansion of the ring band arms during rotation thereof from the position shown in FIG. 11.

FIGS. 11 and 12 show that the enlarged heads 60 at the ends of the pin 18 allow the arms 22, 24 to be separated from each other in order to remove the projections from their associated detents when rotating the gem mount 16 between the ring and pendant configurations. It is noted, when the arms are separated, that inner portions of the enlarged heads 60 are received in the holes 34, 36 provided in the arms, where it is understood, that the diameter of the enlarged heads is greater than the diameters of the holes 34, 36, so that the entire head cannot pass through the holes.

Accordingly, FIG. 12 shows the expansion or separation of the arms 22, 24 when the gem mount 16 is being rotated. As shown, the arms 22, 24 move away from each other in the direction of the arrows as the gem mount is being rotated with its upper end being turned into the drawing as shown in FIG. 12. Thus, as the gem mount is being rotated from the ring configuration 10 of FIG. 11 into the pendant configuration 12, the projections 38 of the arms 22, 24 are being directed towards the detents 58 in the base portion 44, and the projections 50 at the ends of the bridge portion 46 are being directed into the detents 40 in the arms 22, 24. As alignment between the projections and the detents is obtained, the tension on the resilient spring arms 22, 24, which have been pulled apart, will now cause the arms 22, 24 to spring or snap towards each other so that the projections are held or retained in their associated detents. This procedure will be the same when rotating the gem mount 16 from the pendant configuration 12 back to the ring configuration 10.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A convertible finger ring comprising:

a ring band having a generally U-shape to provide a pair of spaced apart resilient arms;

an ornamental gem mount having a portion disposed between said ring band arms;

pivot means pivotally connecting said gem mount portion to said ring band arms for rotating said gem mount relative to said ring band between a ring configuration and a pendant configuration, said gem mount being disposed substantially perpendicular to said ring band in said ring configuration, with said gem mount and said ring band being disposed substantially in one plane in said pendant configuration;

positioning means for providing removable engagement between said gem mount portion and said ring band arms to selectively position said gem mount in one of said ring and pendant configurations with said resilient ring band arms maintaining said engagement;

stop means to limit the rotation of said gem mount relative to said ring band to substantially 90 degrees so that said gem mount is prevented from being rotated beyond said ring and pendant configurations;

said stop means including a pair of opposed shoulder members disposed on said gem mount for abutting against said ring band arms respectively; and sides of said shoulder members abutting against said ring band arms in said ring configuration, and adjacent edges of said shoulder members abutting against said ring band arms in said pendant configuration, each of said shoulder member sides being substantially perpendicular to an associated one of said shoulder member edges, and said shoulder members being spaced from said pivot means to allow said shoulder members to rotate with said gem mount into abutment with said ring band arms.

2. A convertible finger ring according to claim 1, wherein said pivot means includes a pin disposed through aligned openings provided in said gem mount portion and said ring band arms.

3. A convertible finger ring according to claim 2, wherein enlarged heads are provided on opposite ends of said pin to prevent removal of said pin from said openings, said openings having smaller diameters than said enlarged heads.

4. A convertible finger ring according to claim 1, wherein said positioning means includes cooperating projections and detents provided on said gem mount and said ring band arms with said resilient ring band arms acting to retain said projections in associated ones of said detents in said ring and pendant configurations.

5. A convertible finger ring according to claim 4, wherein each of said ring band arms is provided with one of said projections, and said gem mount is provided with a first pair of said detents for receiving said arm projections in said ring configuration, said gem mount being provided with a second pair of said detents for receiving said arm projections in said pendant configuration.

6. A convertible finger ring according to claim 5, wherein said arm projections face each other, and at least one of said first and second pairs of detents is disposed on opposite sides of said gem mount, the spacing between said arm projections being substantially equal to the smallest distance between said at least one pair of detents so that said arm projections must be moved apart in order to remove said arm projections from said at least one pair of detents.

7. A convertible finger ring according to claim 1, wherein said ring band includes a pair of spaced apart opening means extending through said ring band for receiving and retaining a chain therein so that said pendant configuration can be worn on the chain.

8. A convertible finger ring comprising:

a ring band having a generally U-shape to provide a pair of spaced apart resilient arms;

an ornamental gem mount having a portion disposed between said ring band arms;

pivot means pivotally connecting said gem mount portion to said ring band arms for rotating said gem mount relative to said ring band between a ring configuration and a pendant configuration, said gem mount being disposed substantially perpendicular to said ring band in said ring configuration, with said gem mount and said ring band being disposed substantially in one plane in said pendant configuration;

positioning means for providing removable engagement between said gem mount portion and said ring band arms to selectively position said gem mount in one of said ring and pendant configurations with said resilient ring band arms maintaining said engagement;

said positioning means including cooperating projections and detents provided on said gem mount and said ring band arms with said resilient ring band arms acting to retain said projections in associated ones of said detents in said ring and pendant configurations;

said gem mount being provided with a pair of said projections in the form of opposed projections, and said ring band arms being provided with a first pair of said detents for receiving said gem mount projections in said ring configuration, said ring band arms being provided with a second pair of said detents for receiving said gem mount projections in said pendant configuration; and each of said ring band arms being further provided with another of said projections, said gem mount being further provided with a third pair of said detents for receiving said arm projections in said ring configuration, and said gem mount being still further provided with a fourth pair of said detents for receiving said arm projections in said pendant configuration, whereby said first and third pairs of detents cooperate together in said ring configuration, and said second and fourth pairs of detents cooperate together in said pendant configuration.

9. A convertible finger ring according to claim 8, further comprising stop means to limit the rotation of said gem mount relative to said ring band to substantially 90 degrees so that said gem mount is prevented from being rotated beyond said ring and pendant configurations.

10. A convertible finger ring according to claim 8, wherein said ring band includes a pair of spaced apart opening means extending through said ring band for receiving and retaining a chain therein so that said pendant configuration can be worn on the chain.

11. A convertible finger ring according to claim 8, wherein said pivot means includes a pin disposed through aligned openings provided in said gem mount portion and said ring band arms.

12. A convertible finger ring according to claim 11, wherein enlarged heads are provided on opposite ends of said pin to prevent removal of said pin from said openings, said openings having smaller diameters than said enlarged heads.

* * * * *